US006568963B2

(12) United States Patent
Zhang et al.

(10) Patent No.: US 6,568,963 B2
(45) Date of Patent: May 27, 2003

(54) ELECTRICAL CONNECTOR ASSEMBLY WITH IMPROVED CONTACTS

(75) Inventors: Jian-Qiang Zhang, Kunsan (CN); Li-Qi Liu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 52 days.

(21) Appl. No.: 09/960,107

(22) Filed: Sep. 20, 2001

(65) Prior Publication Data

US 2003/0045173 A1 Mar. 6, 2003

(51) Int. Cl.[7] ..... H01R 24/04
(52) U.S. Cl. ..... 439/668
(58) Field of Search ..... 439/188, 668, 439/669, 944; 200/51.1

(56) References Cited

U.S. PATENT DOCUMENTS 5,092,795 A * 3/1992 Kitagawa ..... 439/668
5,201,677 A * 4/1993 Takayama ..... 439/668
6,126,465 A * 10/2000 Franks, Jr. ..... 439/218
6,244,905 B1 * 6/2001 Wang ..... 439/668
6,346,013 B1 * 2/2002 Zhang et al. ..... 439/668

* cited by examiner

*Primary Examiner*—Khiem Nguyen
(74) *Attorney, Agent, or Firm*—Wei Te Chung

(57) ABSTRACT

An electrical connector assembly (7) including an audio jack connector (1) and a DC jack connector (3), has a housing (10), a set of audio contacts (20) and two sets of powering contacts (30, 50). The housing has a plurality of retaining grooves (119, 120, 117, 118, 126, 127, 128, 129). The set of audio contacts has a plurality of audio contacts (21, 22, 24, 23, 25). The audio contacts have locating tabs (211, 221, 244, 231) and contact tabs (217, 226, 247, 237, 254). The set of powering contacts has a plurality of powering contacts (31, 32, 51, 53, 54) forming a first and second circuit loops. The powering contacts have a rigid pin (531) and contact tabs (516, 543). The rigid pin and the contact tabs are separately disposed.

12 Claims, 6 Drawing Sheets

ELECTRICAL CONNECTOR ASSEMBLY WITH IMPROVED CONTACTS

FIELD OF THE INVENTION

The present invention generally relates to an electrical connector assembly, and more particularly to an electrical connector assembly including an audio jack connector and a DC jack connector.

BACKGROUND OF THE INVENTION

It is well known that an audio jack connector of a general mobile phone has a housing and a set of audio contacts, wherein the housing has a elongated mating hole receiving an audio jack and a plurality of passageways. In assembly, the passageways retain the set of audio contacts, each contact having a tail portion with a contact tab. The tail portion extends out of the housing through a corresponding passageway. Thus the contacts of the audio jack connector are pressed to a printed circuit board (PCB) to form an electrical connection. The passageways extend through the housing, receiving part of the contacts, so the contacts could not be retained steadily in the housing after the audio jack connector is mounted on the PCB. Thus an inconvenient and unreliable connection between the contacts and the audio plug is formed, and signal between the audio jack connector and the PCB could not be transmitted properly for the contact tabs could not be held down to a same plane.

Mobile phones use DC jack connectors to charge. The connectors are usually provided with two sets of powering contacts adapted respectively for two types of powering devices.

CN patent No. 99256239.2 discloses a DC jack connector connecting to two powering devices. The DC jack connector is provided with a first connecting element, a second connecting element, a first set of powering contacts and a second set of powering contacts connecting to a first powering device and a second powering device respectively. The first set of powering contacts has a first powering contact and a second powering contact. The second set of powering contacts has a third powering contact and a fourth powering contact. A rigid pin extending from one end of the third powering contact connects to the internal terminal of the second powering device. A flexible arm extending from the other end of the third powering contact is formed above the rigid pin. The fourth powering contact has a second flexible arm. The second powering contact, the fourth powering contact and the second connecting element form a first circuit loop, and the first powering contact, the third powering contact and the first connecting element form a second circuit loop. The two circuit loops connect to the PCB of the mobile phone through a first and second flexible arms.

However, the powering contacts of the prior art do not have locating tabs, so that the powering contacts could not be retained securely in the housing. Furthermore, the rigid pin and the first flexible arm of the third powering contact are integrated resulting in a complicated process and a great waste.

Hence, an improved electrical connector assembly with improved audio contacts and powering contacts is needed to overcome the forgoing shortcomings.

BRIEF SUMMARY OF THE INVENTION

A main object of the present invention is to provide an electrical connector assembly, wherein contacts of the electrical connector assembly could be deposited in a housing steadily and be made easily.

Another object of the present invention is to provide an electrical connector assembly used with an audio plug and two powering devices.

A further object of the present invention is to provide an electrical connector assembly forming a reliable connection between a printed circuit board (PCB) and the electrical connector assembly.

An electrical connector assembly according to the present invention includes a housing, a set of audio contacts, a first and second sets of powering contacts. The housing defines a plurality of channels and retaining grooves, an audio jack and a DC jack. The set of audio contacts has a plurality of audio contacts, each contact having a base portion, a locating tab and a contact tab. The first set of powering contacts has a first and second powering contacts, each powering contact having a base portion, a tab, a mating portion and a detent portion. The second set of powering contacts has a third powering contact, a fourth powering contact, a connecting element, a fifth and sixth powering contacts, each powering contact having a base portion or a locating tab. Each of the third and the fifth powering contacts has a contact tab, and the fourth powering contact has a rigid pin.

In assembly, the base portions of the contacts are received in the channels of the housing, and the locating tabs of the contacts are retained in the retaining grooves. The contact tabs of the audio contacts are assembled on a same plane, so that the audio contacts connect with circuitries of the PCB reliably. A first circuit loop is formed among the second and third powering contacts, the sixth powering contact and the connecting element, and a second circuit loop is formed among the first powering contact, the fourth powering contact and the fifth powering contact. The first and second circuit loops connect respectively with the circuitries of the PCB to the powering devices through the sixth and seventh contact tabs.

Other objects, advantages and novel features of the invention will become more apparent from the following detailed description of a preferred embodiment when taken in conjunction with the accompanying drawings.

DETAILED DESCRIPTION OF THE INVENTION

Figure 1:
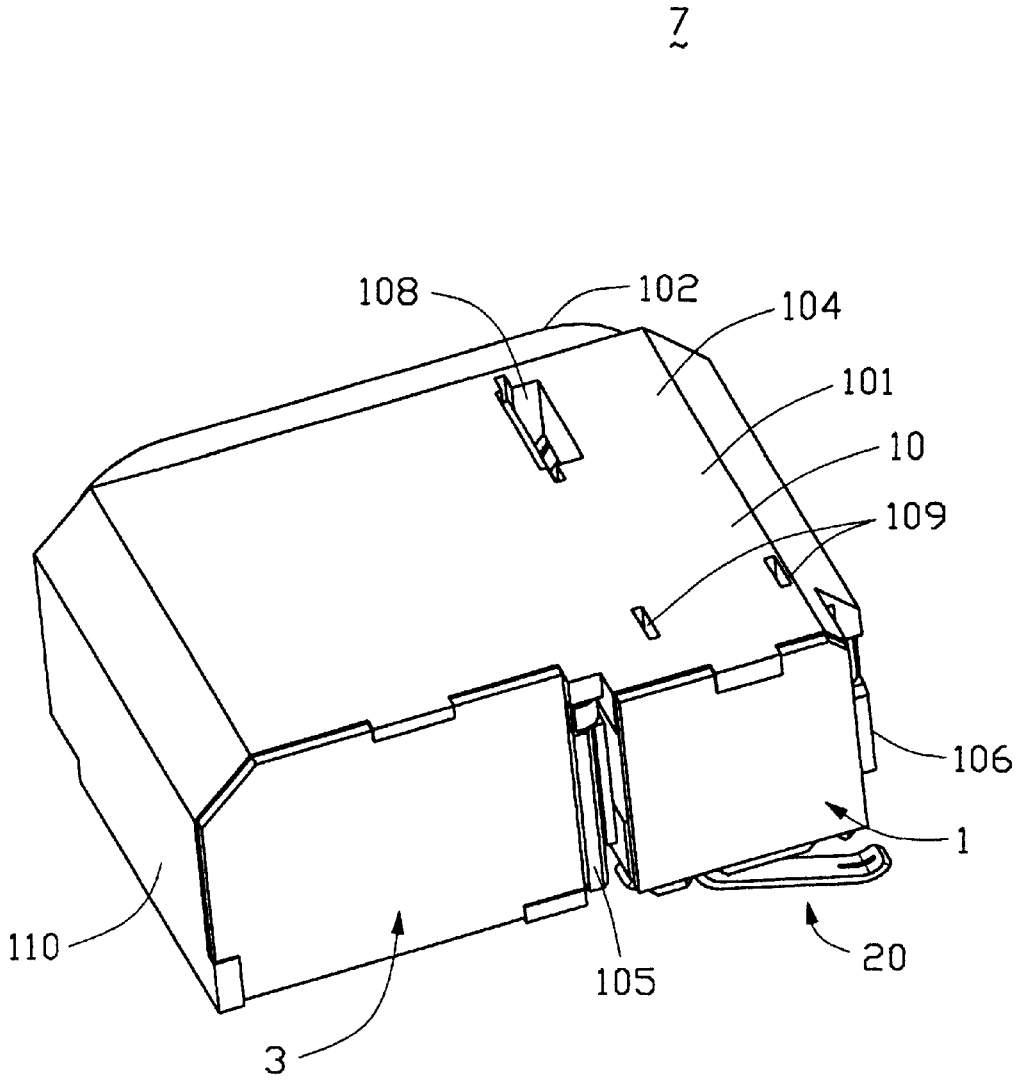
FIG. 1 is a perspective view of an electrical connector assembly according to the present invention.
Figure 2:
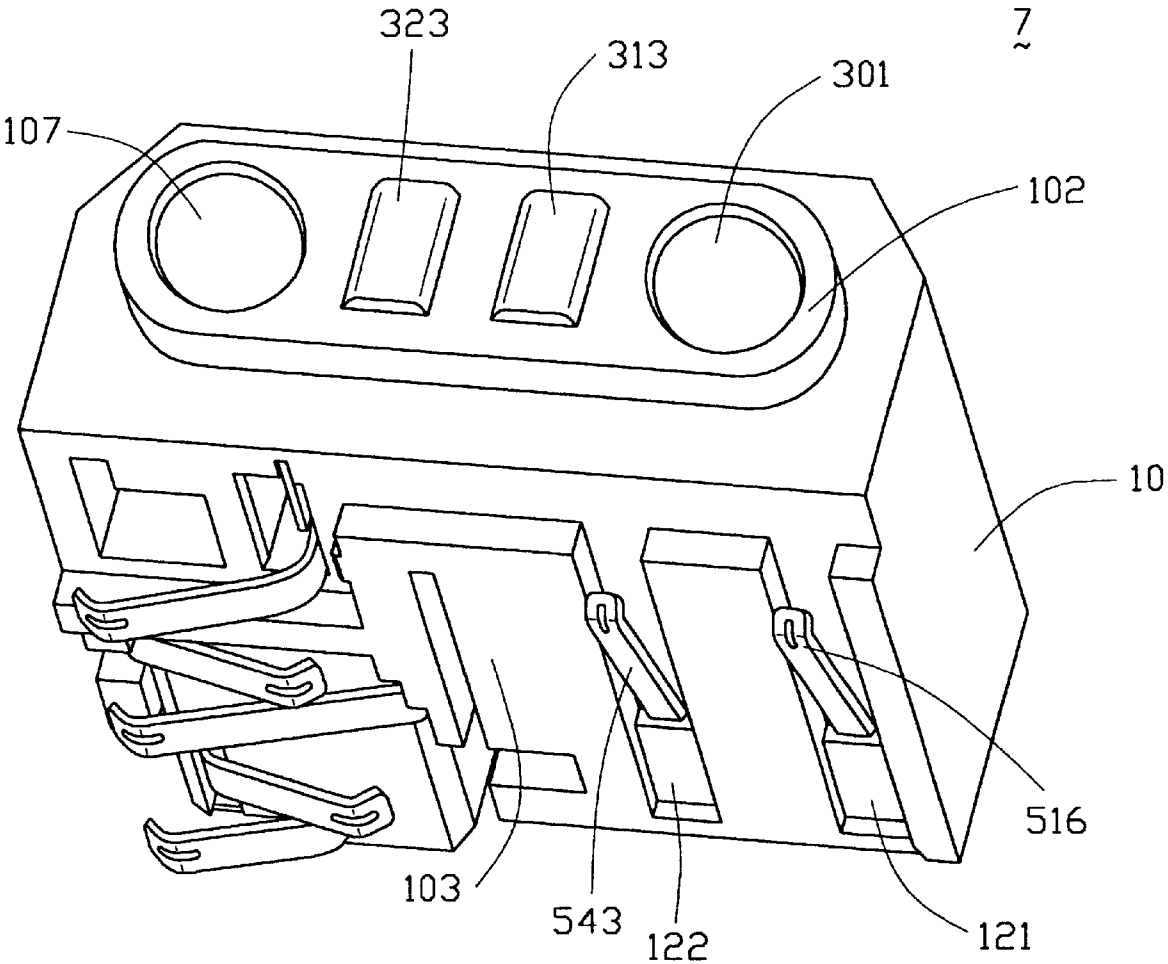
FIG. 2 is another perspective view of the electrical connector assembly of FIG. 1.
Figure 3:
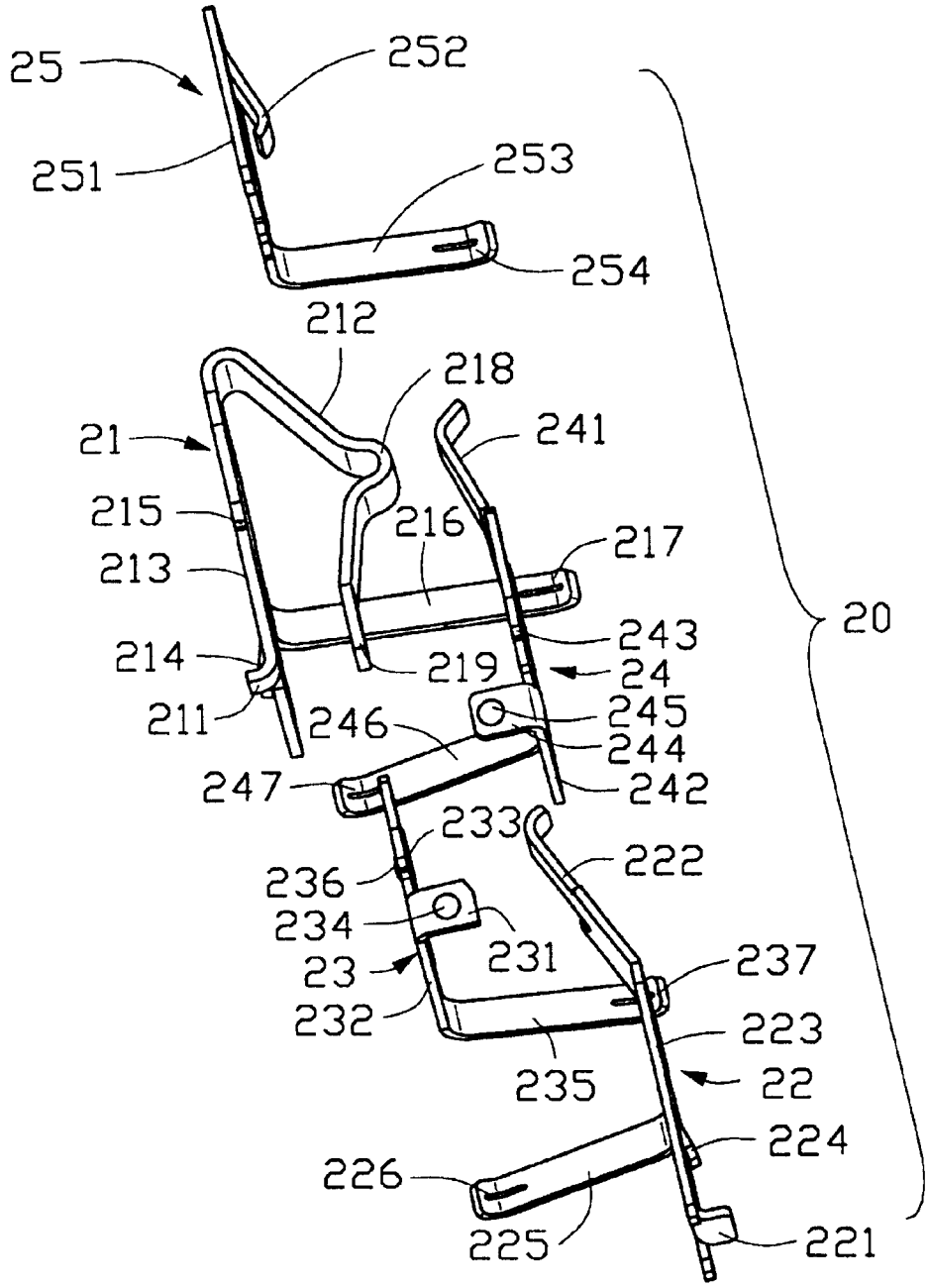
FIG. 3 is a perspective view of a set of audio contacts of the electrical connector assembly.
Figure 6:
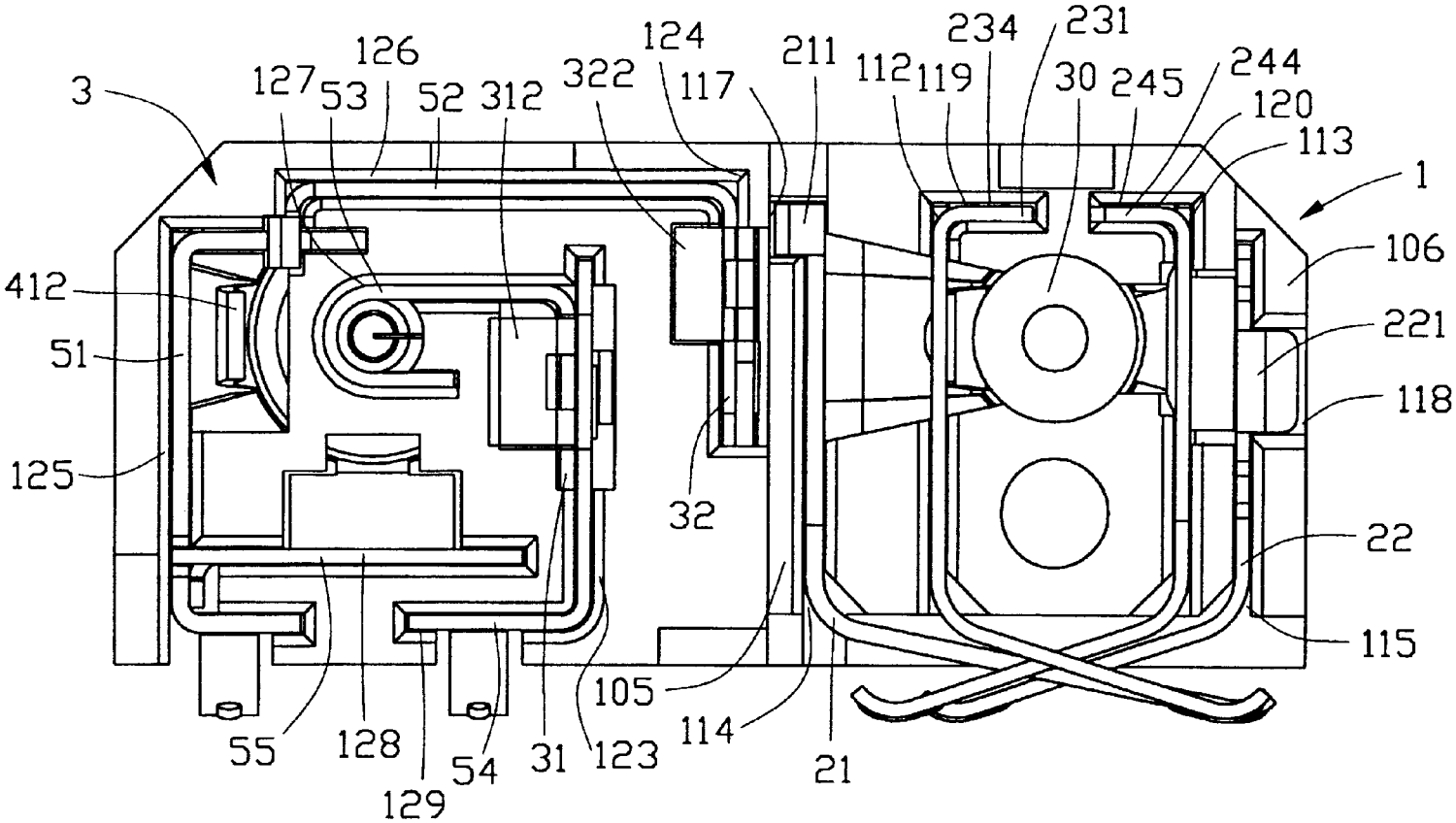
FIG. 6 is a front elevational view of the electrical connector assembly of FIG. 1, wherein the front cover of the electrical connector assembly is removed for clarity.

Referring to FIG. 1, FIG. 2 and FIG. 6, an electrical connector assembly 7 has a housing 10, an audio jack connector 1 and a DC jack connector 3. The audio jack connector 1 is mounted in the housing 10 of the electrical connector assembly 7, and has a set of audio contacts 20 (as shown in FIG. 3). The DC jack connector 3 is mounted in the housing 10 of the electrical connector assembly 7, and has a first set of powering contacts 30 and a second set of powering contacts 50 (as shown in the FIG. 4).

The housing 10 has a main body 101, a mating wall 102, an audio jack 107 and a powering jack 301 going through the main body 101 to the mating wall 102. The main body 101 includes a mounting wall 103, a top wall 104, a first sidewall 105, a second sidewall 106 and a third sidewall 110. A first slot 108 is defined on the top wall 104 adjacent to the mating wall 102 and the first sidewall 105. A pair of slits 109 is defined on the top wall 104 adjacent to the first sidewall 105 and the second sidewall 106. A first channel 112 and a second channel 113 are defined vertically in the housing 10 adjacent to the first sidewall 105 and the second sidewall 106. A third channel 114 is defined between the first wall 105 and the first channel 112, and a fourth channel 115 is defined between the second wall 106 and the second channel 113. A fifth channel 123, a sixth channel 124 and a seventh channel 125 are defined vertically adjacent to the third sidewall 110 and the second sidewall 106 in the housing 10. A first retaining groove 119 and a second retaining groove 120 are defined perpendicularly to the first channel 112 and the second channel 113 respectively. A third retaining groove 117 and a fourth retaining groove 118 are defined respectively in the first sidewall 105 and the second sidewall 106. A fifth retaining groove 126 is defined perpendicularly to the sixth channel 124 with one end communicating with the sixth channel 124, a seventh retaining groove 128 is defined perpendicularly to the seventh channel 125 with one end communicating with the seventh channel 125. A sixth retaining groove 127 and a eighth retaining groove 129 are defined at each end of the fifth channel 123. The sixth and the eighth retaining grooves are perpendicular to the fifth channel 123 and communicating with the fifth channel 123. A pair of mounting channels (not labeled) for receiving the first set of powering contacts 30 is communicating with the sixth channel 124 and the seventh channel 125.

Referring to FIG. 3, the set of audio contacts 20 has a first audio contact 21, a second audio contact 22, a third audio contact 24, a fourth audio contact 23 and a fifth audio contact 25. The first audio contact 21 has a first spring contact arm 212, a first base portion 213, a first locating tab 211 extending from the first base portion 213, a first protrusion 214 and a first tail portion 216 extending from a middle portion of the base portion 213. An actuator 218 extends forwardly from the first spring contact arm 212, and a spring contact portion 219 extends forwardly from the actuator 218. A first barb 215 is formed on an edge of the first base portion 213, a first contact tab 217 extends from a distal end of the first tail portion 216.

The second audio contact 22 has a second spring contact arm 222, a second base portion 223, a second locating tab 221 extending from the second base portion 223, a second protrusion 224 and a second tail portion 225 extending from a middle portion of the second base portion 223. A second contact tab 226 extends from a distal end of the second tail portion 225.

The third audio contact 24 has a third spring contact arm 241, a third base portion 242, a third locating tab 244 extending inwardly from a top edge of the third base portion 242 and a third tail portion 246 extending outwardly from a lower edge of the third base portion 242. A third bard 243 is formed on a top edge of the third base portion 242, a third sustain protrusion 245 is formed on a top surface of the third locating tab 244. A third contact tab 247 extends from a distal end of the third tail portion 246.

The fourth audio contact 23 has a fourth base portion 232, a fourth locating tab 231 extending inwardly from an edge of the fourth base portion 232 and a fourth tail portion 235 extending inwardly from a lower edge of the fourth base portion 232. The fourth locating tab 231 extends perpendicularly to the fourth base portion 232. A fourth bard 233 is formed on a top edge of the fourth base portion 232, and a switch tab 236 is formed on an edge of the fourth base portion 232. The fourth sustain protrusion 234 is formed on a top surface of the fourth locating tab 231. A fourth contact tab 237 extends from a distal end of the fourth tail portion 235.

The fifth audio contact 25 has a fifth base portion 251, a fifth spring contact arm 252 and a fifth tail portion 253 extending from a lower edge of the fifth base portion 251. A fifth contact tab 254 extends from a distal end of the fifth tail portion 253.

Figure 4:
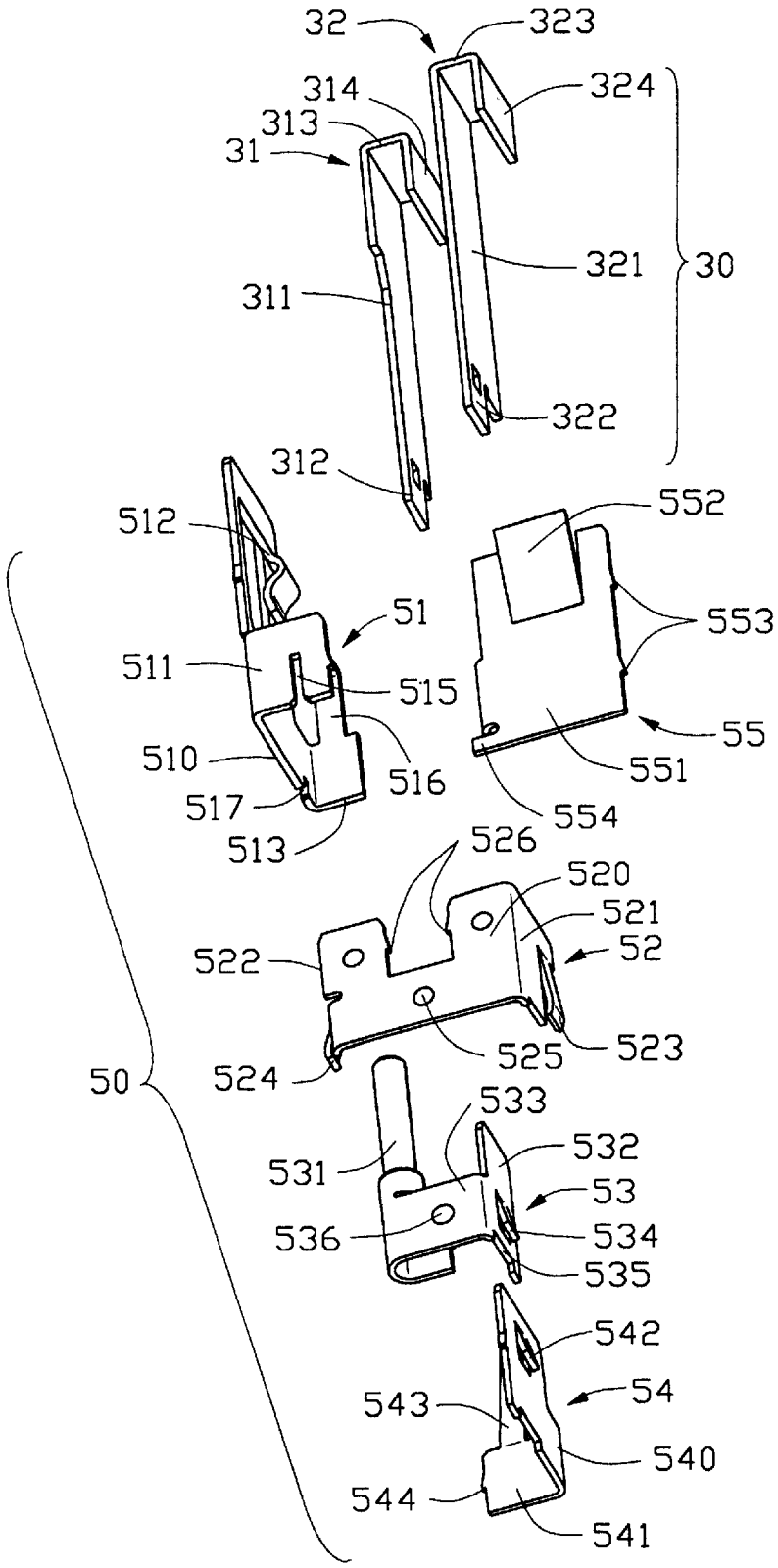
FIG. 4 is perspective view of two sets of powering contacts of the electrical connector assembly.

Referring to FIG. 4, the first set of powering contacts 30 includes a first powering contact 31 and a second powering contact 32. The first and second powering contacts 31, 32 have a sixth and seventh base portion 311, 321. A first and second tabs 312, 322 extend respectively from front ends of the sixth and seventh base portions 311, 321. A first and second mating portions 313, 323 extend respectively from rear ends of the sixth and seventh base portions 311, 321, and the first and second mating portions 313, 323 extend perpendicularly to the sixth and seventh base portions 311, 321. A first and second detent portion 314, 324 extend perpendicularly from free ends of the first and second mating portions 313, 323, each extending perpendicularly to the first and second mating portions 313, 323.

The second set of powering contacts 50 includes a third powering contact 51, a connecting element 52, a fourth powering contact 53, a fifth powering contact 54 and a sixth powering contact 55. The third powering contact 51 has a longitudinal eighth base portion 510, a first and second plates 511, 513 extending inwardly from two opposite edges of the eighth base portion 510 and a first resilient arm 512 extending inwardly from a front end of the eighth base portion 510. The first and second plates 511, 513 extend perpendicularly to the eighth base portion 510. A notch 515 is defined on a middle portion of the first plate 511, a second slot 517 is defined on a rear end of the eighth base portion 510, and a sixth contact tab 516 extends downwardly from a front end of the second plate 513.

The connecting element 52 has a eighth locating tab 520, a first and second side plates 521, 522 extending downwardly from two sides of the eighth locating tab 520 and perpendicularly to the eighth locating tab 520, and a first and second hooks 523, 524 extending outwardly and respectively from rear ends of the first and second side plates 521, 522. A plurality of second sustain protrusions 525 and fifth barbs 526 are formed on the eighth locating tab 520.

The fourth powering contact 53 has a rigid pin 531, a first blade 532 extending parallel to the rigid pin 531 and a ninth locating tab 533 connecting the rigid pin 531 to the first blade 532. An indentation 535 is defined in one end of the first blade 532, and a third hook 534 is formed on one side of the first blade 532. A plurality of third sustain protrusions 536 is formed on a middle portion of the ninth locating tab 533.

The fifth powering contact 54 has a tenth locating tab 541, a third plate 540 extending upwardly from the tenth locating tab 541, a fourth hook 542 extending from a rear end of the tenth locating tab 541 and a seventh contact tab 543 extending forwardly from the tenth locating tab 541. A plurality of barbs 544 is formed on one side of the tenth locating tab 541.

The sixth powering contact 55 has an eleventh locating tab 551, a second resilient arm 552 extending from a front end of the eleventh locating tab 551 and a locking tab 554 extending from a rear end of the eleventh locating tab 551. A plurality of seventh barbs 553 is formed on one side of the eleventh locating tab 551.

Figure 5:
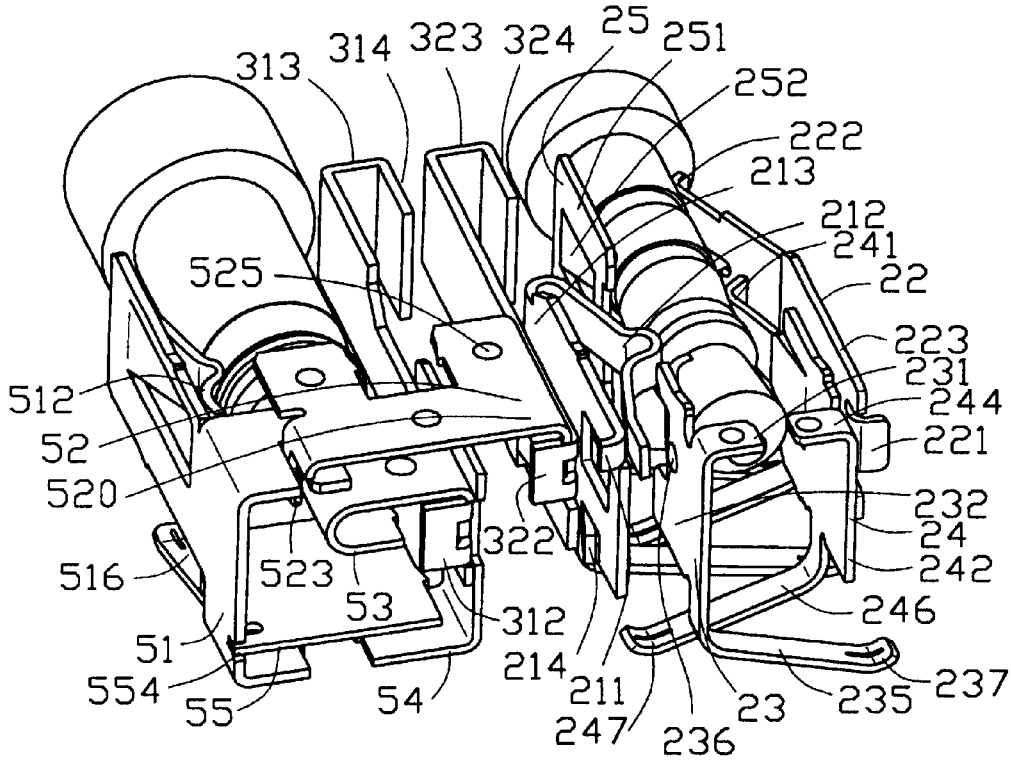
FIG. 5 is an assembled view of the contacts of FIG. 3 and FIG. 4, wherein mating plugs are inserted, showing a connection between the plugs and the contacts.

Referring to FIG. 5 and FIG. 6, in assembly, each tail portion 216, 225, 246, 235, 253 of the audio contacts 21, 22, 24, 23, 25 extends out of the mounting wall 103 of the housing 10. The first audio contact 21 is received in the third channel 114 of the housing 10, the first protrusion 214 and the first barb 215 abut against the inner wall (not shown) of the housing 10. The first locating tab 211 is retained in the third retaining groove 117, so that the first audio contact 21 could be securely mounted in the housing 10.

The second audio contact 22 is received in the fourth channel 115 with the second protrusion 224 abutting against the inner wall of the housing 10. The second locating tab 221 is retained in the fourth retaining groove 118, so that the second audio contact 22 could be retained in the housing 10 steadily.

The fourth and third audio contacts 23, 24 are received respectively in the first and second channels 112, 113 with the third and fourth barbs 243, 233 received in the slits 109. The fourth and third locating tabs 231, 244 are retained respectively in the first and second retaining grooves 119, 120. The third and fourth sustain protrusions 245, 234 are abutting respectively against the inner wall of the housing, so that the audio contacts 24, 23 could be retained securely in the housing 10.

The fifth base portion 251 of the fifth audio contact 25 is sustained in the first slot 108 of the housing 10.

The first and second powering contacts 31, 32 are received in the fifth and sixth channels 123, 124 of the housing 10 with the first and second detent portions 314, 324 retained in the first and second groove channels (not labeled). The first and second tabs 312, 322 of the first and second powering contacts 31, 32 bend perpendicularly and reverse from the first and second mating portions 313, 323.

The third powering contact 51 is received in the seventh channel 125. The eighth locating tab 520 of the connecting element 52 is retained in the fifth retaining groove 126. The second hook 524 of the connecting element 52 is inserted in the notch 515 of the third powering contact 51, and the first hook 523 abuts against the lower portion of the second tab 322. The plurality of eighth sustain protrusions 525 and fifth barbs 526 are sustained in the housing 10 so that the connecting element 52 could be sustained in the housing 10 steadily. The sixth contact tab 516 of the third powering contact 51 extends out of the mounting wall 103 through the first groove 121 to contact a printed circuit board (PCB) of a mobile phone (not shown).

The ninth locating tab 533 of the fourth powering contact 53 is sustained in the sixth retaining groove 127 with the third hook 534 abutting against one side of the sixth base portion 311 of the first powering contact 31. The first tab 312 bends perpendicularly and is inserted in the indentation 535.

The tenth locating tab 541 of the fifth powering contact 54 is retained in the eighth retaining groove 129 with the fourth hook 542 abutting against the inner wall of the housing 10 and connecting to the sixth base portion 311 tightly. The plurality of sixth barbs 544 is retained in the housing 10. The seventh contact tab 543 of the fifth powering contact 54 extends out of the mounting wall 103 through the second groove 122 to contact the PCB.

The eleventh locating tab 551 of the sixth powering contact 55 is retained in the eighth retaining groove 129 with the second resilient arm 552 contacting a DC plug (not labeled). The plurality of seventh barbs 553 is sustained in the housing 10. The locking tab 554 of the sixth powering contact 55 is inserted in the second slot 517 of the third powering contact 51.

The spring contact portion 219 of the first audio contact 21 contacts the switch tab 136 of the fourth audio contact 23. An audio plug (not labeled) actuates the actuator 218 after the audio plug is inserted into the audio jack 107 so that the spring contact portion 219 separates from the switch tab 236 of the fourth audio contact 23.

The third powering contact 51 and the sixth powering contact 55 are connected by the locking tab 554 inserted in the second slot 517. The second powering contact 32 is connected to the third powering contact 51 by the connecting element 52. The second side plate 524 is inserted in the notch 515 of the third powering contact 51, while the second tab 322 of the second powering contact 32 abuts against the top portion of the first hook 523 of the connecting element 52, so that the second powering contact 32, the third powering contact 51, the sixth powering contact 55 and the connecting element 52 form a first circuit loop. The first tab 312 of the first powering contact 31 engages in the indentation 535 of the fourth powering contact 53 with the third hook 534 abutting against the sixth base portion 311 of the first powering contact 31. The fourth hook 542 of the fifth powering contact 54 abuts against the inner wall (not shown) of the housing 10 so that the fourth hook 542 connects to the sixth base portion 311 of the first powering contact 31 tightly. The fourth powering contact 53, the first powering contact 31 and the fifth powering contact 54 form a second circuit loop. The sixth and the seventh contact tabs 516, 543 respectively extend beyond the housing 10 through the first and second grooves 121, 122 for connecting to circuitries of the PCB. The first and second circuit loops respectively connect to the circuitries of the PCB through the sixth and seventh contact tabs 516, 543.

In this embodiment, the audio contacts 21, 22, 23, 24, the powering contacts 53, 54, 55 and the connecting element 52 have locating tabs 211, 221, 231, 244, 533, 541, 551, 520 such that the audio contacts 21, 22, 23, 24, the powering contacts 53, 54, 55 and the connecting element 52 could be securely retained in the housing 10. The contact tabs 217, 226, 237, 247, 254, 516, 543 are formed on a same plane after the audio contacts 21, 22, 23, 24 are retained in the housing 10, thus a reliable connection is formed between the audio contacts 21, 22, 23, 24, 25 and the PCB. The rigid pin 531 of the fourth powering contact 53 and the seventh contact tab 543 are separately produced, thus the producing process is easier than prior arts.

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, used with an audio plug and two power supplements, comprising:

a housing defining a plurality of retaining grooves, a mounting wall with a first groove and a second groove therein, an audio jack and a powering jack;

a plurality of audio contacts, each audio contact having a base portion, a locating tab retained in the retaining groove, a tail portion extending from the base portion and a contact tab extending from a distal end of the tail portion;

a first set of powering contacts, including a first powering contact and a second powering contact; and a second set of powering contacts, including a third powering contact, a fourth powering contact, a fifth powering contact and a connecting element, the third powering contact and the fifth powering contact having a sixth contact tab and a seventh contact tab extending respectively out of the first groove and the second groove, the fourth powering contact having a rigid pin extending into the powering jack without contacting the third powering contact;

wherein the second powering contact, the third powering contact and the connecting element form a first circuit loop connecting to a printed circuit board (PCB) through the sixth contact tab, and the fourth powering contact, the first powering contact and the fifth powering contact form a second circuit loop connecting to the PCB through the seventh contact tab.

2. The electrical connector assembly of claim 1, wherein the housing includes a plurality of channels receiving the base portions of the audio contacts and the powering contacts.

3. The electrical connector assembly of claim 2, wherein the retaining grooves of the housing are defined at ends of the channels of the housing.

4. The electrical connector assembly of claim 1, wherein the locating tabs of the audio contacts and the powering contacts extend from the base portions.

5. The electrical connector assembly of claim 1, wherein the second set of powering contacts further comprises a sixth powering contact having a second resilient arm extending into the powering jack, an electrical connection being formed between the sixth powering contact and the third powering contact.

6. The electrical connector assembly of claim 1, wherein the third powering contact has a first resilient arm extending into the powering jack.

7. The electrical connector assembly of claim 1, wherein the first and second powering contacts have a sixth and seventh base portions, a first and second tabs extending horizontally from ends of the sixth and seventh base portions, a first and second mating portions extending perpendicularly from the opposite ends of the sixth and seventh base portions.

8. The electrical connector assembly of claim 1, wherein a first and second detent portions extend from distal ends of the first and second mating portion, the first and second detent portions extending parallel to the sixth and seventh base portions.

9. The electrical connector assembly of claim 1, wherein the third powering contact further has an eighth base portion, a first and second plates extending horizontally from two ends of the eighth base portion, the sixth contact tab extending from one end of the second plate.

10. The electrical connector assembly of claim 1, wherein the connecting element includes an eighth locating tab and two side plates extending downwardly from two sides of the eighth locating tab to form a first hook inserted into the notch of the fifth powering contact and a second hook engaging with the seventh base portion.

11. An electrical connector assembly comprising:

an insulative housing having a main body with thereof a audio jack and a power jack extending in a front-to-back direction;

a plurality of audio contacts surrounding the audio jack;

a first set of power contacts positioned between the audio jack and the power jack; and a second set of power contacts surrounding the power jack; wherein one of the first set of power contacts are mechanically and electrically connected to some of said second set of power contacts, and the other of the first set of power contacts are mechanically and electrically connected to others of said second set of power contacts.

12. An electrical connector assembly comprising:

an insulative housing having a main body with thereof a audio jack and a power jack extending in a front-to-back direction;

a plurality of audio contacts surrounding the audio jack;

a first set of power contacts positioned between the audio jack and the power jack; and a second set of power contacts surrounding the power jack;

the audio contacts, the first set of power contacts and the second set of power contacts being forwardly inserted into the housing; wherein below a bottom face of the housing, the audio contacts have contact tabs extending downwardly and laterally while the second set of power contacts have contact tabs extending downwardly and along said front-to-back direction; and wherein the first set of power contacts have no contact tabs extending below the bottom face of the housing.

* * * * *